US008106826B2

(12) United States Patent
Fox

(10) Patent No.: US 8,106,826 B2
(45) Date of Patent: Jan. 31, 2012

(54) ANTENNA ARRANGEMENT

(75) Inventor: Andrew John Fox, Wiltshire (GB)

(73) Assignee: Deltenna Limited (GB)

( * ) Notice: Subject to any disclaimer, the term of this patent is extended or adjusted under 35 U.S.C. 154(b) by 0 days.

(21) Appl. No.: 11/996,419

(22) PCT Filed: Jul. 21, 2006

(86) PCT No.: PCT/GB2006/002731
§ 371 (c)(1),
(2), (4) Date: Jun. 10, 2008

(87) PCT Pub. No.: WO2007/010274
PCT Pub. Date: Jan. 25, 2007

(65) Prior Publication Data

US 2008/0246663 A1 Oct. 9, 2008

(30) Foreign Application Priority Data

Jul. 22, 2005 (GB) ..... 0515185.7

(51) Int. Cl.
*H01Q 3/00* (2006.01)

(52) U.S. Cl. ..... 342/373; 342/372

(58) Field of Classification Search ..... 342/154, 342/372, 373; 343/700 MS; 455/562.1
See application file for complete search history.

(56) References Cited

U.S. PATENT DOCUMENTS

| | | | |
|---|---|---|---|
| 4,965,588 A | 10/1990 | Lenormand et al. | |
| 4,980,692 A | 12/1990 | Rudish et al. | |
| 5,177,453 A | 1/1993 | Russell et al. | |
| 5,179,386 A | 1/1993 | Rudish et al. | |
| 5,339,086 A | 8/1994 | DeLuca et al. | |
| 5,471,220 A | 11/1995 | Hammers et al. | |
| 5,789,978 A | 8/1998 | Zhang et al. | |
| 6,175,555 B1 | 1/2001 | Hoole | |
| 2003/0090417 A1 | 5/2003 | Kenyon Vail et al. | |
| 2004/0192392 A1 | 9/2004 | Hoppenstein et al. | |
| 2007/0129034 A1 * | 6/2007 | Adams et al. | 455/138 |

FOREIGN PATENT DOCUMENTS

| | | |
|---|---|---|
| DE | 3742270 | 2/1989 |
| GB | 2281011 | 2/1995 |
| GB | 2300076 | 10/1996 |
| JP | 05107335 | 4/1993 |

OTHER PUBLICATIONS

International Search Report; PCT/GB2006/002731; Dec. 13, 2006.
Great Britain Search Report; GB0515185.7; Sep. 20, 2005.

* cited by examiner

*Primary Examiner* — Dao Phan
(74) *Attorney, Agent, or Firm* — Cantor Colburn LLP

(57) ABSTRACT

An antenna has multiple antenna elements, with a beam forming Butler matrix, having antenna ports and input/output ports, with each of said antenna elements being connected to a respective port of the beam forming Butler matrix. Transceiver circuitry is connected to each of the input/output ports of the beam forming matrix by means of respective distinct transmit and receive paths and a respective duplexer. Individually controllable gain control elements are located in each of the transmit and receive paths. These can be controlled in response to signal strength measurements made by the antenna.

46 Claims, 5 Drawing Sheets

ANTENNA ARRANGEMENT

TECHNICAL FIELD OF THE INVENTION

This invention relates to an antenna arrangement, and in particular to a self-installable antenna arrangement with a controllable field pattern.

BRIEF DISCUSSION OF RELATED ART

In a wireless communications network, such as a mobile communications network in which portable devices are able to communicate over radio channels, the operator provides a network of base stations. Each of the base stations has one or more antennas, and is able to communicate with portable devices in one or more cells, such that the cells together provide coverage over the whole service area of the network. The extent of each cell depends on the properties of the antenna that provides the coverage for that cell. If the antenna transmits signals with high power, and receives signals with high sensitivity, the cell is relatively large, while if the antenna transmits signals with low power, and receives signals with low sensitivity, the cell is relatively small.

The cells must be sufficiently large that the network of base stations can provide coverage over the whole service area. However, if the cells are too large then, since the available communications frequencies are reused in multiple cells, there will be interference between the transmissions on a particular frequency in one cell and the transmissions on the same frequency in another cell.

Moreover, many features of the network can be changed dynamically. For example, base stations can be added to the network, or taken out of service, and frequencies can be reallocated from one base station to another. It is therefore important to be able to alter the size of a cell, and this can be done most conveniently by changing the properties of the antenna.

BRIEF SUMMARY OF THE INVENTION

According to a first aspect of the present invention, there is provided an antenna, comprising:

- a plurality of antenna elements;
- a beam forming Butler matrix, having a plurality of antenna ports and a plurality of input/output ports, with each of said antenna elements being connected to a respective port of the beam forming Butler matrix;
- transceiver circuitry, connected to each of the plurality of input/output ports of the beam forming matrix by means of respective distinct transmit and receive paths and a respective duplexer; and
- individually controllable gain control elements located in each of the transmit and receive paths.

According to a second aspect of the present invention, there is provided an antenna, comprising:

- a plurality of antenna elements;
- transceiver circuitry, connected to each of the plurality of antenna elements by means of respective transmit and receive paths; and
- individually controllable gain control elements located in each of the transmit and receive paths, and further comprising:
- means for detecting signal strengths of received signals; and
- means for controlling said gain control elements on the basis of the detected signal strengths.

According to a third aspect of the present invention, there is provided a method of controlling an antenna, wherein the antenna comprises:

- a plurality of antenna elements; and
- transceiver circuitry, connected to each of the plurality of antenna elements by means of respective transmit and receive paths;

wherein the method comprises:

- individually controlling gain control elements located in each of the transmit and receive paths.

According to a fourth aspect of the present invention, there is provided a base station for a cellular wireless communications network, comprising an antenna in accordance with the first or second aspect of the invention.

According to a fifth aspect of the present invention, there is provided an antenna, comprising:

- an antenna element;
- transceiver circuitry;
- a transmit path, for passing signals from the transceiver circuitry to the antenna element, and containing at least one gain control element;
- a receive path, for passing signals from the antenna element to the transceiver circuitry, and containing at least one gain control element;
- a duplexer, connected between the antenna element and the transmit and receive paths;
- a first band pass filter, connected in the transmit path, for performing a blocking function; and
- a second band pass filter, connected in the receive path, for performing a blocking function.

BRIEF DESCRIPTION OF THE DRAWINGS

The invention will now be described with reference to the accompanying drawings, in which.

DETAILED DESCRIPTION OF THE INVENTION

Figure 1:
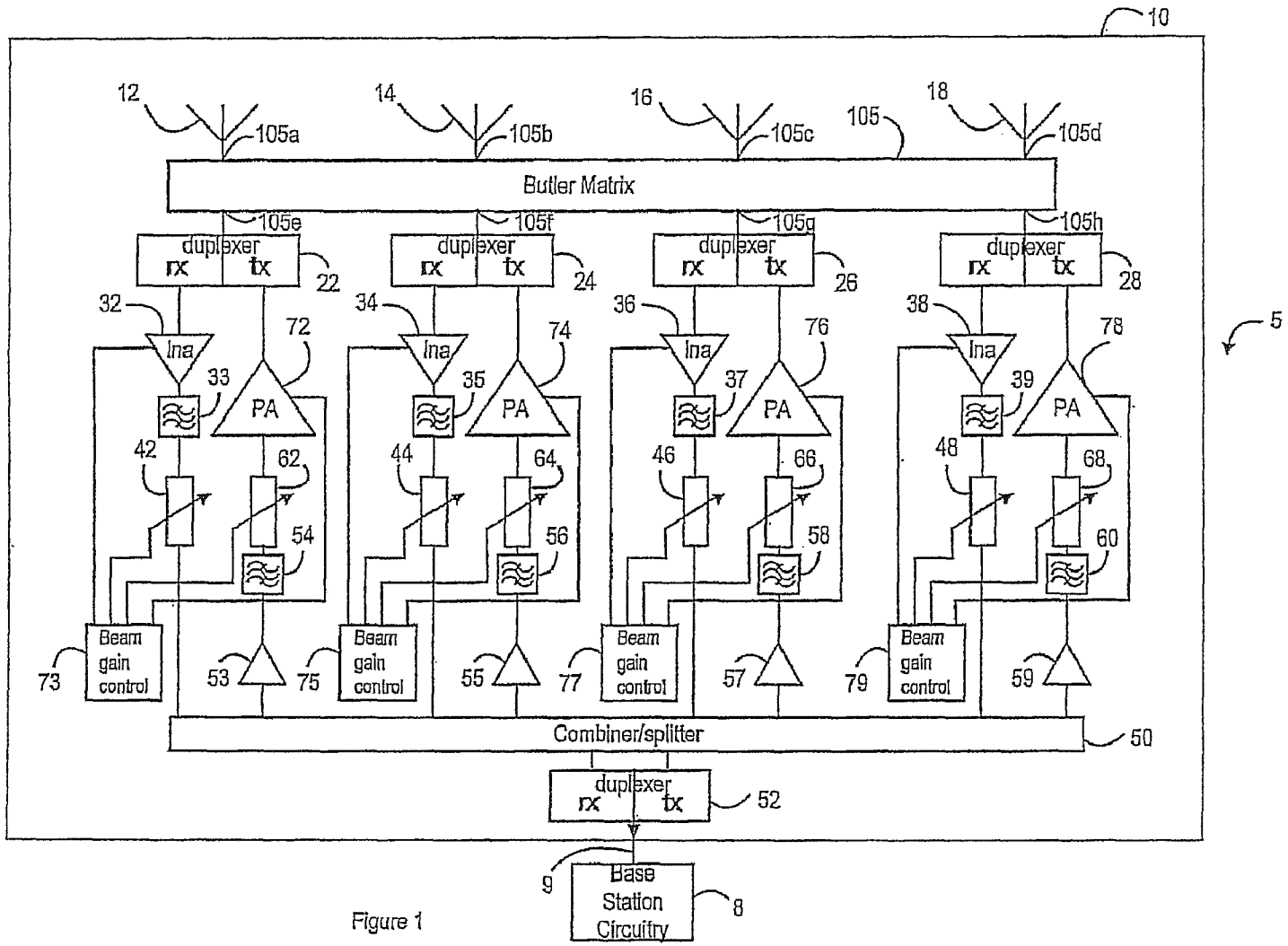
FIG. 1 is a block schematic diagram of an antenna in accordance with the present invention.

FIG. 1 shows a base station 5 including generally conventional base station circuitry 8 and an antenna 10 in accordance with the present invention. As is well known, a base station of a cellular wireless communications network can be located in the centre of the cell that it is serving, in which case an omnidirectional antenna is required, or it can be located adjacent two or more cells, in which case it requires a directional antenna for each of the cells that it is serving. The invention will be described herein with reference to its use in an omnidirectional antenna. However, it will be apparent that the invention can also be applied to a directional antenna.

As shown in FIG. 1, the base station 5 includes one antenna 10, although it could include more than one such antenna, and, in that case, each of the antennas may be omnidirectional or directional.

The antenna 10 includes four antenna elements 12, 14, 16, 18, each of which provides a part of the omnidirectional coverage of the antenna 10, as will be described in more detail below. Each of the antenna elements 12, 14, 16, 18 can represent a respective array of antenna elements.

Signals received by the four antenna elements 12, 14, 16, 18 are passed to respective duplexers 22, 24, 26, 28, and through the receive (rx) paths of the duplexers to respective low noise amplifiers (lna) 32, 34, 36, 38. The amplified signals are passed through respective band-pass filters 33, 35, 37, 39, and through first attenuators 42, 44, 46, 48, which may be either analog or digital, to a combiner/splitter 50, and into the receive path (rx) of a further duplexer 52.

The received signal, obtained by combining the signals received by the four antenna elements 12, 14, 16, 18, is then passed to the base station circuitry 8, radio frequency transceiver circuitry (not shown), which is conventional, and will not be described further.

This radio frequency interface 9 between the antenna element 10, as shown in FIG. 1, and the base station circuitry 8 can be over fibre, over a coaxial cable where the received and transmitted signals are recombined and split as required by means of the duplexer 52, or using digitised radio frequency signals. Further, DC power can be either supplied direct to the antenna element 10, or can be injected on the radio frequency interface cable.

Signals for transmission by the antenna 10 are generated in the radio frequency transceiver circuitry (not shown), and passed to the transmit path (tx) of the further duplexer 52, and then to the combiner/splitter 50, where they are split into four identical signals. These signals are passed to respective driver amplifiers 53, 55, 57, 59, and then to respective band pass filters 54, 56, 58, 60 to second attenuators 62, 64, 66, 68, which may be either analog or digital, and then to respective power amplifiers 72, 74, 76, 78.

The amplified signals are passed through the transmit paths (tx) of the respective duplexers 22, 24, 26, 28 to the four antenna elements 12, 14, 16, 18.

Each of the four antenna elements 12, 14, 16, 18 also has an associated beam gain control unit 73, 75, 77, 79, which is connected to the respective one of the low noise amplifiers (lna) 32, 34, 36, 38; the respective one of the first attenuators 42, 44, 46, 48; the respective one of the second attenuators 62, 64, 66, 68; and the respective one of the power amplifiers 72, 74, 76, 78.

The amplitudes of the signals transmitted from the four antenna elements 12, 14, 16, 18 can thus be controlled either by switching the power amplifiers 72, 74, 76, 78 off completely, or by controlling the respective levels of attenuation applied by the second attenuators 62, 64, 66, 68. When signals are being transmitted, and hence the power amplifiers 72, 74, 76, 78 are switched on, the bias applied to each of the power amplifiers 72, 74, 76, 78 can be adjusted based on the degree of attenuation (if any) applied by the respective one of the second attenuators 62, 64, 66, 68. This can then ensure that each of the power amplifiers 72, 74, 76, 78 is operating at a high efficiency.

Similarly, the gains applied to the signals received by the four antenna elements 12, 14, 16, 18 can be controlled either by switching the low noise amplifiers (lna) 32, 34, 36, 38 off completely, or by controlling the respective levels of attenuation applied by the first attenuators 42, 44, 46, 48.

It will be noted that the filters 33, 35, 37, 39 and 54, 56, 58, 60 perform some of the blocking that would otherwise need to be carried out in the four duplexers 22, 24, 26, 28.

In more detail, in the receive path, the four duplexers 22, 24, 26, 28 only need to provide filters with a relatively low pole count, in order to prevent the transmit signal, and some of the out of band blocking signals, from compressing the receiver. However, the filters in the receive paths of the duplexers 22, 24, 26, 28 do not need to reject signals at frequencies close to the receive frequency. Rather, this filtering of close out of band blocking signals is provided by the filters 33, 35, 37, 39, which can advantageously be quasi-elliptic filters. This allows the size of the duplexer to be significantly reduced.

In the transmit path, the filters 54, 56, 58, 60 remove the transmit noise at the receive frequencies. The result is that the filters in the transmit paths of the duplexers 22, 24, 26, 28 only need to remove the noise generated in the respective power amplifiers 72, 74, 76, 78. The result is that the requirements on the filters in the transmit paths of the duplexers 22, 24, 26, 28 are reduced, and relatively low pole count filters can be used.

It should also be noted that this distribution of the duplexer filter functionality can also be performed when there is only one transmit/receive path, and one antenna element. That is, compared with FIG. 1, there is no Butler matrix, and no need to split the signals from the transceiver circuitry, or combine the signals to the transceiver circuitry. Thus, a band pass filter can be provided after the amplifier in the receive path, and a band pass filter can be provided before the power amplifier in the transmit path, in order to provide some of the blocking that would otherwise need to be carried out in the duplexer, as described above.

Figure 2:
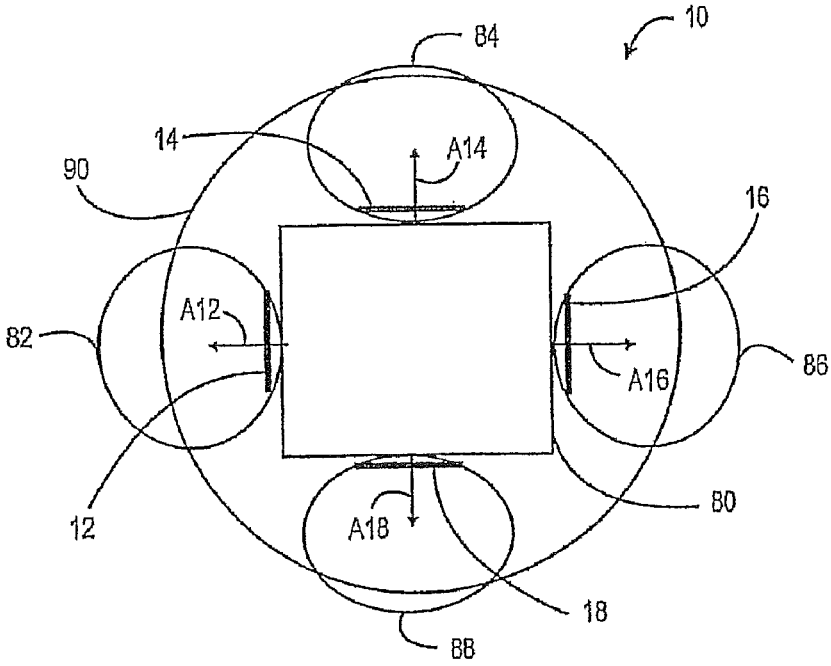
FIG. 2 is a schematic illustration of the properties of the antenna of FIG. 1, in use.
Figure 3:
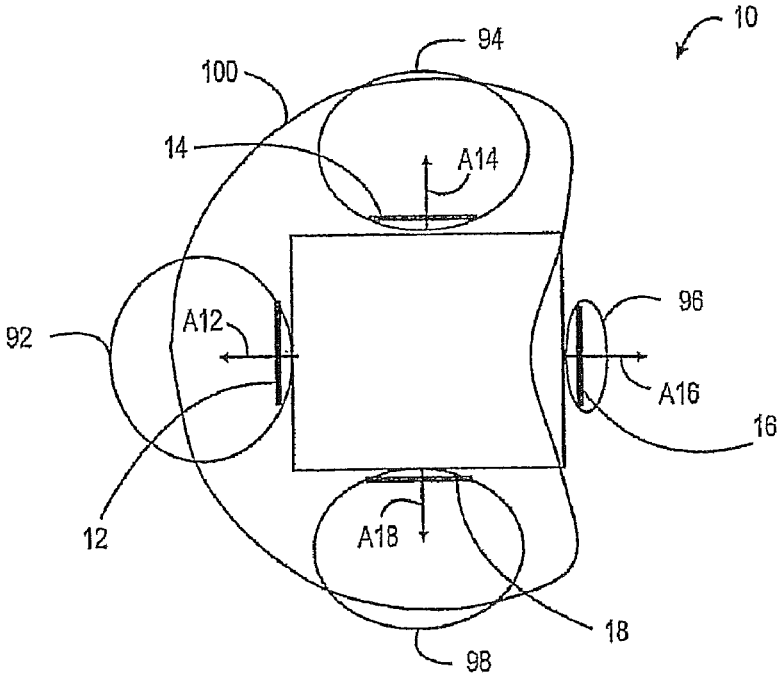
FIG. 3 is a schematic illustration of the properties of the antenna of FIG. 1, after modification.

FIGS. 2 and 3 show the operation of the antenna 10. Specifically, FIG. 2 shows the four antenna elements 12, 14, 16, 18 mounted on an antenna structure 80, which may, for example, be a mast or a tower. The antenna elements 12, 14, 16, 18 themselves are directional. That is, they have a direction in which they preferentially transmit, and from which they preferentially receive, signals. These preferential directions of the antenna elements 12, 14, 16, 18 are indicated in FIG. 2 by means of the arrows A12, A14, A16, A18 respectively.

As is well known, the preferential directions indicated by the arrows A12, A14, A16, A18 are determined primarily by the physical orientations of the respective antenna elements 12, 14, 16, 18. However, for example when the antenna elements 12, 14, 16, 18 are each made up a number of smaller elements, the preferential direction of each antenna element can then be adjusted by controlling the relative phases of the signals applied to those smaller elements, for example by means of a beam forming Butler matrix. Thus, FIG. 1 shows a Butler matrix 105, having respective antenna ports 105*a*, 105*b*, 105*c*, 105*d* connected to the antenna elements 12, 14, 16, 18, and having respective input/output ports 105*e*, 105*f*, 105*g*, 105*h* connected to the respective duplexers 22, 24, 26, 28.

FIG. 2 illustrates the beams 82, 84, 86, 88 associated with the respective antenna elements 12, 14, 16, 18. Thus, the beams 82, 84, 86, 88 are directed in the respective preferential directions indicated by the arrows A12, A14, A16, A18, and the size and shape of the illustrated beams 82, 84, 86, 88 represents in a schematic way the size and shape of the area over which the corresponding antenna element can communicate with the wireless mobile devices in the system. Further, FIG. 2 illustrates a beam 90, which is the sum of the beams 82, 84, 86, 88. Again, the size and shape of the illustrated beam 90 represents in a schematic way the size and shape of the area over which the antenna 10 can communicate with the wireless mobile devices in the system.

In the situation illustrated in FIG. 2, the beams 82, 84, 86, 88 all have the same size. That is, the amplifiers 32, 72; 34, 74; 36, 76; 38, 78 are all switched on, and the attenuators 42, 44, 46, 48, 68 associated with the respective receive paths of each of the antenna elements are set to the same level, as are the attenuators 62, 64, 66, 68 associated with the respective transmit paths of each of the antenna elements. The result is that the beam 90 is generally circular, and so the antenna 10 can be regarded as omnidirectional; that is, it radiates generally constantly in all directions.

Moreover, in this illustrated situation, the attenuation values of the corresponding pairs of attenuator elements 42, 62; 44, 64; 46, 66; 48, 68 are set to ensure that the size of the area over which the antenna 10 can receive signals from the wireless mobile devices in the system is essentially the same as the size of the area over which the antenna 10 can transmit signals to the wireless mobile devices in the system. However, it will be noted that this need not be the case, and that the attenuation values of the attenuator elements could be set such that the link is asymmetrical, that is, such that one of these sizes is greater than the other.

FIG. 3 illustrates an alternative mode of operation of the antenna 10. In FIG. 3, the beams 92, 94, 96, 98 are associated with the respective antenna elements 12, 14, 16, 18. Again, the beams 92, 94, 96, 98 are directed in the respective preferential directions indicated by the arrows A12, A14, A16, A18, and the size and shape of the illustrated beams 92, 94, 96, 98 represents in a schematic way the size and shape of the area over which the corresponding antenna element can communicate with the wireless mobile devices in the system. Further, FIG. 3 illustrates a beam 100, which is the sum of the beams 92, 94, 96, 98. Again, the size and shape of the illustrated beam 100 represents in a schematic way the size and shape of the area over which the antenna 10 can communicate with the wireless mobile devices in the system.

In the situation illustrated in FIG. 3, the beam 96 is considerably smaller than the beams 92, 94, 98. That is, the amplifiers 32, 72; 34, 74; 36, 76; 38, 78 are all switched on, but the attenuators 46, 66 associated with the antenna element 16 is set to provide a higher degree of attenuation than the attenuators 42, 62; 44, 64; 48, 68 associated with the other antenna elements. The result is that the beam 100 is no longer circular, and so the antenna 10 can be controlled such that it becomes a directional antenna, radiating in preferred directions.

As before, the attenuation values of the corresponding pairs of attenuator elements 42, 62; 44, 64; 46, 66; 48, 68 are set to ensure that the size and shape of the area over which the antenna 10 can receive signals from the wireless mobile devices in the system are essentially the same as the size and shape of the area over which the antenna 10 can transmit signals to the wireless mobile devices in the system. Again, however, it will be noted that this need not be the case, and that the attenuation values of the attenuator elements could be set such that the link is asymmetrical, that is, such that these shapes are different, and/or such that one of these sizes is greater than the other.

When the shape of the beam 100 is changed, as is shown in FIG. 3, the transmission power, or the gain in the receive signal path, does not increase, compared with the situation where the beam 90 is omnidirectional, as is shown in FIG. 2. That is, even though the size of the cell is reduced in one direction, it is not increased in other directions.

Figure 4:
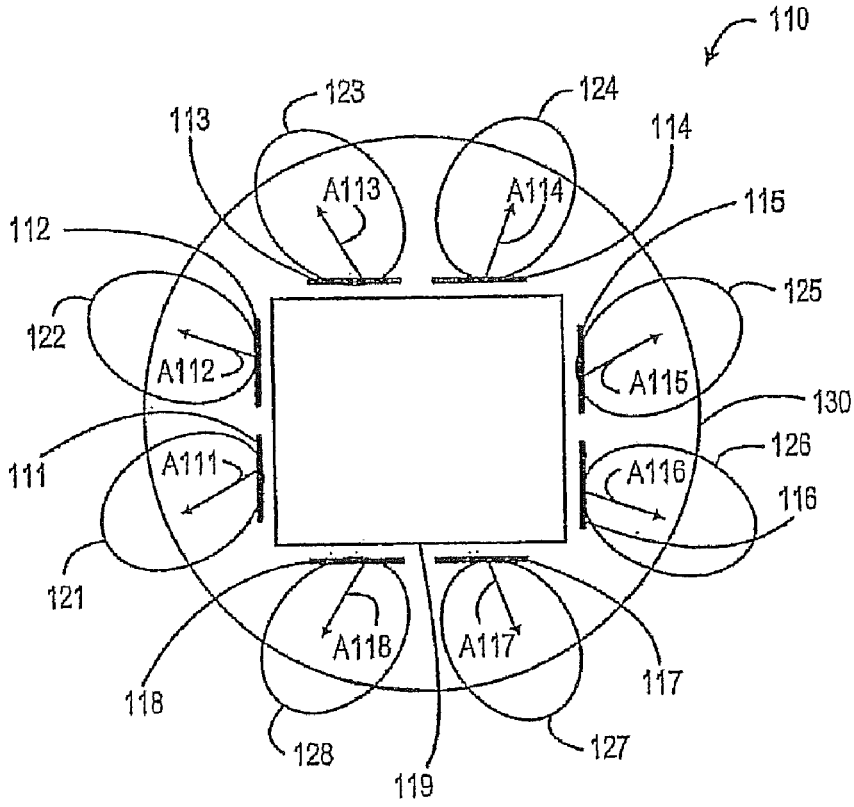
FIG. 4 is a schematic illustration of the properties of a second antenna in accordance with the present invention, in use.
Figure 5:
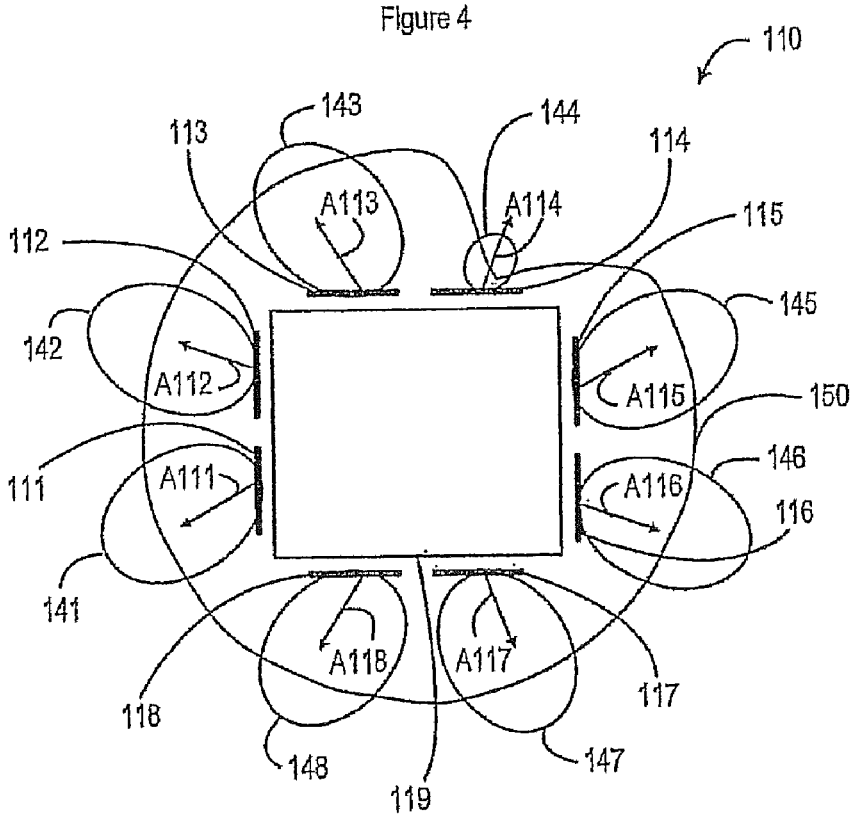
FIG. 5 is a schematic illustration of the properties of the second antenna in accordance with the present invention, after modification.

FIGS. 4 and 5 show the operation of an alternative antenna 110 in accordance with the present invention. Specifically, FIG. 3 shows eight antenna elements 111, 112, 113, 114, 115, 116, 117, 118 mounted on an antenna structure 119, which may, for example, be a mast or a tower. The antenna elements 111-118 are directional. That is, they have a direction in which they preferentially transmit, and from which they preferentially receive, signals. These preferential directions of the antenna elements 111-118 are indicated in FIG. 4 by means of the arrows A11, A12, A13, A14, A15, A16, A17, A18 respectively.

As described with reference to FIG. 2, the preferential directions indicated by the arrows A111-A118 are determined primarily by the physical orientations of the respective antenna elements 111-118, but they can be adjusted by controlling the relative phases of the signals applied to them, for example by means of a Butler matrix.

FIG. 4 illustrates the beams 121, 122, 123, 124, 125, 126, 127, 128 associated with the respective antenna elements. Thus, the beams 121-128 are directed in the respective preferential directions indicated by the arrows A111-A118, and the size and shape of the illustrated beams 121-128 represents in a schematic way the size and shape of the area over which the corresponding antenna element can communicate with the wireless mobile devices in the system. Further, FIG. 4 illustrates a beam 130, which is the sum of the beams 121-128. Again, the size and shape of the illustrated beam 130 represents in a schematic way the size and shape of the area over which the antenna 110 can communicate with the wireless mobile devices in the system.

The antenna 110 has eight antenna elements 111-118, compared with the four antenna elements in the antenna 10. However, the control circuitry associated with each of the eight antenna elements 111-118 is the same as the control circuitry associated with each of the four antenna elements in the antenna 10, as shown in FIG. 1, and so it will not be shown or described further.

In the situation illustrated in FIG. 4, the beams 121-128 all have the same size. That is, the amplifiers associated with the eight antenna elements 111-118 are all switched on, and the attenuators associated with each of the antenna elements are set to the same level. The result is that the beam 130 is generally circular, and so the antenna 110 can be regarded as omnidirectional; that is, it radiates generally constantly in all directions, and receives signals with generally equal sensitivity from all directions, and the cell size for transmission is generally equal to the cell size for reception.

FIG. 5 illustrates an alternative mode of operation of the antenna 110. In FIG. 5, the beams 141, 142, 143, 144, 145, 146, 147, 148 are associated with the respective antenna elements 111-118. Again, the beams 141-148 are directed in the respective preferential directions indicated by the arrows A111-A118, and the size and shape of the illustrated beams 141-148 represents in a schematic way the size and shape of the area over which the corresponding antenna element can communicate with the wireless mobile devices in the system. Further, FIG. 5 illustrates a beam 150, which is the sum of the beams 141-148. Again, the size and shape of the illustrated beam 150 represents in a schematic way the size and shape of the area over which the antenna 110 can communicate with the wireless mobile devices in the system.

In the situation illustrated in FIG. 5, the beam 144 is considerably smaller than the other seven beams. That is, the amplifiers associated with the eight antenna elements 111-118 are all switched on, but the attenuators in the transmit and receive signal paths of the antenna element 114 are set to provide a higher degree of attenuation than the attenuators associated with the other antenna elements. The result is that the beam 150 is no longer circular, illustrating how the antenna 110 can be controlled such that it becomes a directional antenna, radiating in preferred directions.

When the shape of the beam 150 is changed, as is shown in FIG. 5, the transmission power, or the gain in the receive signal path, does not increase, compared with the situation where the beam 130 is omnidirectional, as is shown in FIG. 4. That is, although the cell size in the preferred direction A114 of the antenna element 114 is reduced, the cell size in the other directions remains essentially the same as in the case where the beam is omnidirectional.

Thus, FIGS. 2 and 3, and FIGS. 4 and 5, give examples as to how the field pattern of an antenna can be controlled, by individually controlling the beams which make up the field pattern.

It will be appreciated that, in all embodiments of the invention, the beam can use linear polarisation, dual slant 45° polarisation, or circular polarisation.

According to a further aspect of the present invention, the field pattern can be controlled automatically, on the basis of signal strength measurements made at the antenna itself.

Figure 6:
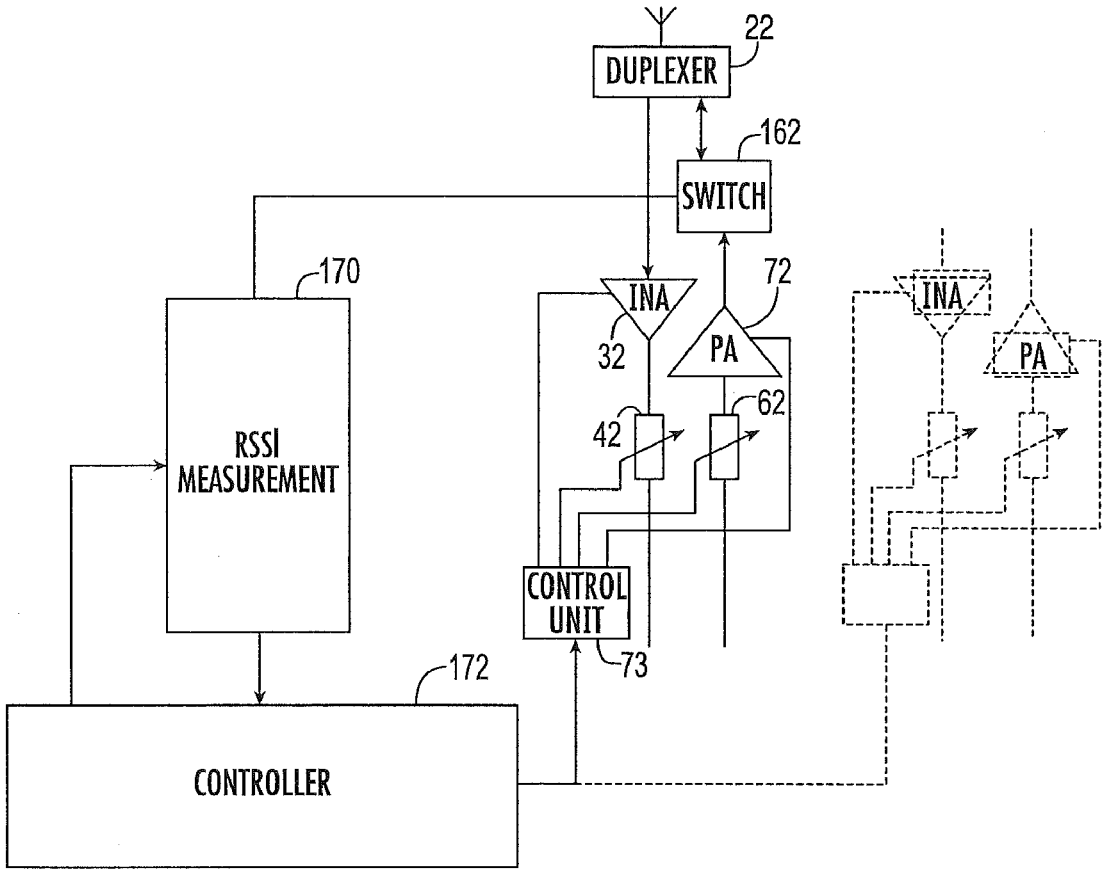
FIG. 6 is a block schematic diagram of an alternative antenna in accordance with the present invention.

FIG. 6 shows a part of the circuitry required to implement this control arrangement. Specifically, FIG. 6 shows the low noise amplifier 32 and the attenuator 42 in the receive path for signals received at the antenna element 12 and the duplexer 22 of the antenna shown in FIG. 1, as well as the attenuator 62 and the power amplifier 72. FIG. 6 also shows the beam gain control unit 73 connected to send control signals to the low noise amplifier 32, the first attenuator 42, the second attenuator 62 and the power amplifier 72.

As shown in FIG. 6, a switch, or coupler, 162 is connected to the output of the power amplifier 72. A similar switch, or coupler, is similarly connected to the outputs of each of the other power amplifiers (not shown in FIG. 6). As also shown in FIG. 6, a RSSI measurement block 170 is connected to receive signals from each of these switches, or couplers. Although shown in FIG. 6 as connected to the circuitry associated with the first antenna element 12, the RSSI measurement block 170 is also connected in the same way to the circuitry associated with the other antenna elements, however many of such other antenna elements there may be.

Either operating at radio frequencies, or operating at baseband after downconversion of the received radio frequency signals, the RSSI measurement block 170 measures the signal strength of a received signal. The measured RSSI is passed to a controller 172. On the basis of the measured RSSI, and its own logic, which will be described in more detail below, the controller 172 sends control signals to the beam gain control unit 73, enabling it to send control signals to the low noise amplifier 32, the first attenuator 42, the second attenuator 62 and the power amplifier 72. Although shown in FIG. 6 as connected to the circuitry associated with the first antenna element 12, the controller 172 is also connected in the same way to the circuitry associated with the other antenna elements, however many of such other antenna elements there may be. The required digital interface can be in accordance with any industry standard or custom.

The RSS information can be sent from the RSSI measurement block 170 to the controller 172 either wirelessly, for example using the wireless communications standards defined in IEEE 802.11a, b or g, or IEEE 802.16 or similar, or via a wire. The controller 172 can be a software function in a laptop computer or similar portable device, or can be a dedicated hardware device. The controller 172 can be located at the antenna site, or at a network operation centre, in which case, the RSS information can be sent back to the controller 172 via the NodeB in which the antenna is being used, for example in a SMS message.

If the controller 172 is located at the antenna site, the information can be sent from the controller 172 to the base station circuitry 8 shown in FIG. 1 using the RF interface 9 including a fibre or coax link, as described with reference to FIG. 1. The information can then usefully be transferred to the network operation centre.

The controller 172 itself can be configured or controlled by means of signals passed over a dedicated control line, or by means of signals, for example using HTML, passed over an existing connection.

Figure 7:
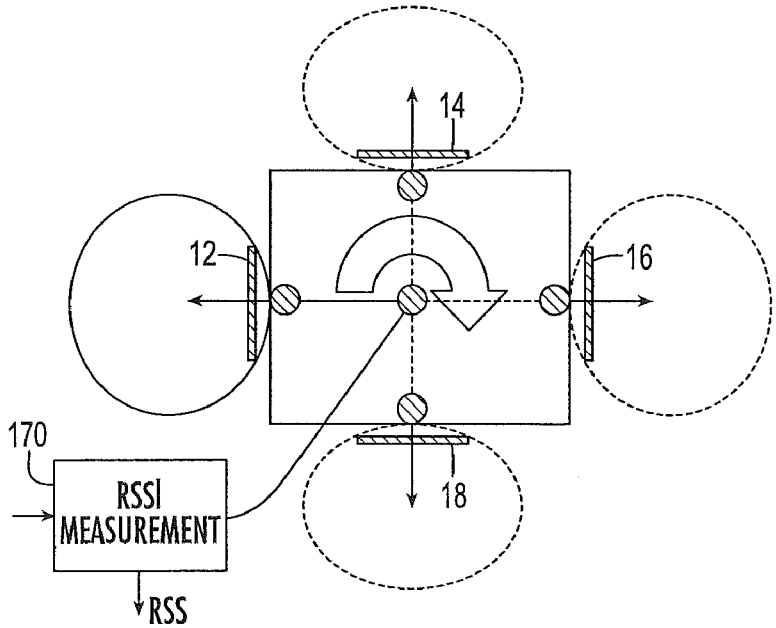
FIG. 7 is a block schematic diagram illustrating the use of the alternative antenna shown in FIG. 6.

FIG. 7 illustrates the operation of the control arrangement shown in FIG. 6. In normal operation of the antenna, the RSSI measurement block 170 is switched off, and signals for transmission are passed through the attenuator 62 and power amplifier 72 in the transmission path to the duplexer 22. The antenna of the present invention is primarily intended for use in telecommunications systems that operate using Frequency Division Duplexing (FDD). That is, signals are transmitted on a particular transmission frequency, usually selected from many available transmission frequencies, and, at the same time, signals are received on a receive frequency, usually selected from many available receive frequencies, with the selected transmission frequency and the selected receive frequency having a fixed frequency difference between them.

However, during an installation phase, which may take place when the antenna is first installed, and as often thereafter as required, the RSSI measurement block 170 is brought into use. Subsequent uses may be initiated by the network operator, or may occur at preprogrammed times or intervals. During such use, the RSSI measurement block 170 is preferably connected to each of the antenna elements in turn. Thus, as shown by the solid line 182 in FIG. 7, the RSSI measurement block 170 is first connected to receive signals from the antenna element 12. After a measurement period is complete, the RSSI measurement block 170 is connected to receive signals from the antenna elements 14, 16 and 18 in turn, for respective measurement periods.

The purpose of the measurements is to determine the signal strengths of the signals being transmitted by the base stations that are relatively close to the base station including the antenna 10. In order to be able to do this, the RSSI measurement block 170 must be able to take measurements on the frequencies at which those base stations are transmitting, which are frequencies at which the mobile devices conventionally receive signals.

For that reason, the RSSI measurement block 170 can include, or can be equivalent to a part of, the circuitry that is conventionally found in a mobile device. Also, it is connected to the switch, or coupler, 162 that is found in the transmit path of the antenna element, so that it can measure the strengths of signals on the available base station transmit frequencies.

Firstly, when it is desired to take signal strength measurements, the switch, or coupler, 162 is controlled such that, instead of passing signals from the transmit path of the antenna element to the duplexer 22, it passes signals from the duplexer 22 to the RSSI measurement block 170. The transmitter is also switched off to ensure that the antenna does not attempt to transmit any signals during the measurement period. The RSSI measurement block 170 is then tuned in turn to the available channels on which nearby base stations of the same network operator may be transmitting.

In a network operating using Time Division Multiple Access (TDMA) with multiple available operating frequencies, it is necessary to tune the RSSI measurement block 170 in turn to each of these frequencies. A signal strength measurement can then be taken for each frequency.

In a network operating using Code Division Multiple Access (CDMA), the RSSI measurement block 170 can advantageously be programmed with the spreading codes (PN codes) used by the other base stations of the network operator. Signal strength measurements can then be taken.

Thus, for each beam in turn, the RSSI measurement block 170 determines the signal strengths of the signals received from the nearby base stations. Based on this information, the RSSI measurement block 170 and the controller 172 can produce as an output a list of the neighbouring base stations and the overall signal strengths of the signals received from each of those base stations.

For example, the controller 172 can produce a display output, and this will allow an operator to set the gain of the transmit/receive paths for each beam, in order to optimise the network parameters, for example in terms of maximising the available signal strengths and minimising the risk of interference between transmissions from different base stations on the same frequency.

Further, the controller 172 can be provided with software that will automatically set the gain of the transmit/receive paths for each beam, in order to optimise the network parameters as described above.

For example, the amount of intercell overlap can be taken as a measurement parameter. A low degree of intercell overlap may mean that there are areas between cells with low signal strength and hence incomplete coverage of the desired network coverage area. A high degree of intercell overlap may mean that there is interference between cells transmitting on the same frequency and hence a reduction in the number of cells that can be handled. The controller 172 can be provided with software that will automatically set the gain of the transmit/receive paths for each beam, in order to optimise the value of this measurement parameter to a desired value. The desired value can itself vary with time, and from one base station to another.

As another example, the gain of the transmit/receive paths for each beam can be controlled in order to provide the required capacity in a particular cell at different times of day or on different days of the week.

The operator can thus adjust the overall beam shape of the antenna, and hence the size and shape of the cell served by the antenna, by controlling the beam shapes associated with the individual antenna elements. Specifically, the power of transmitted signals can be controlled either by switching off the relevant power amplifier or by adjusting the relevant transmission path attenuator, while the gain applied to received signals can be controlled either by switching off the relevant low noise amplifier or by adjusting the relevant reception path attenuator.

The controller 172 could also contain alarm circuitry whereby the operational settings and status are reported back to the interested party, such as the network operator, via any interface available and on any medium such as in software or by means of indicator lights.

Figure 8:
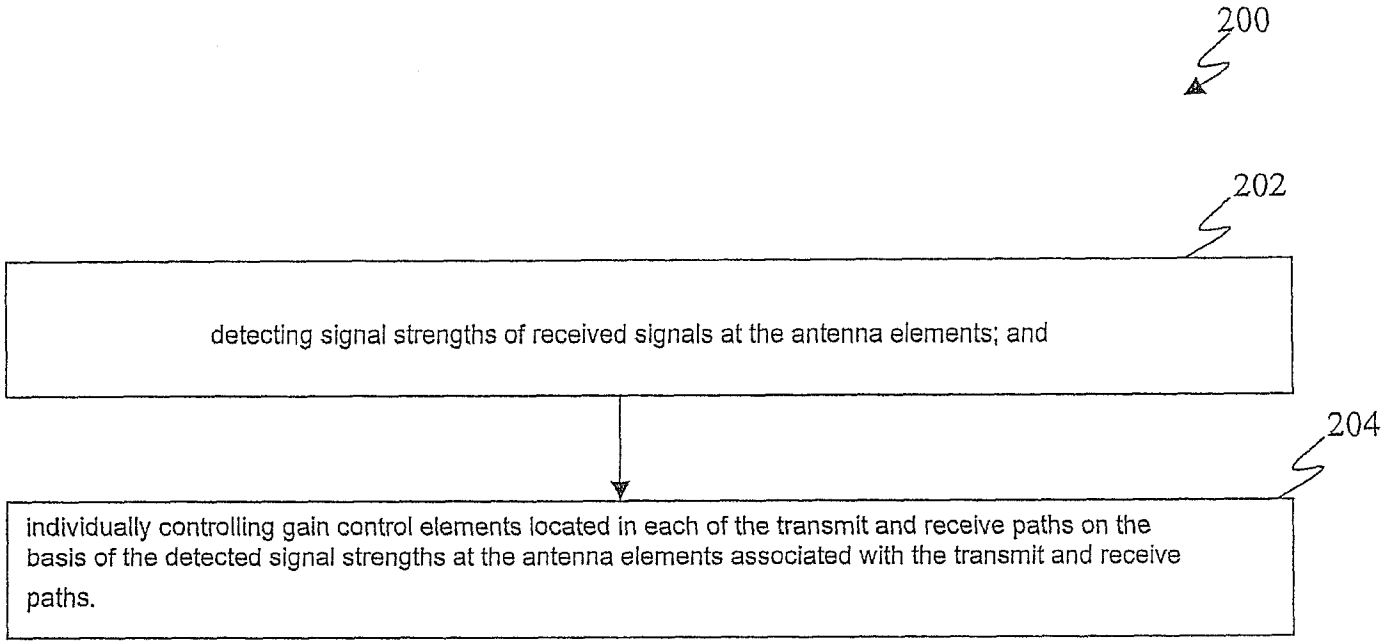
FIG. 8 is a block diagram showing a method of installing an antenna.

With reference to FIG. 8, a method 200 for installing an antenna is illustrated. The method 200 employs an antenna that includes a plurality of antenna elements and transceiver circuitry connected to each of the plurality of antenna elements by means of respective associated transmit and receive paths. The method 200 itself includes detecting signal strengths of received signals at antenna elements, as shown in operational block 202, and individually controlling gain control elements located in each of the transmit and receive paths on the basis of the detected signal strengths at the antenna elements associated with the transmit and receive paths, as shown in operational block 204.

As described above, the RSSI measurement block 170 and controller 172 are used in conjunction with an antenna that is also used to provide wireless communications in a cellular network. However, the RSSI measurement block 170 and controller 172 could alternatively be used in conjunction with a second antenna that is used only for taking RSSI measurements and is co-located with a controllable antenna for example as shown in FIG. 1, where that controllable antenna is used to provide wireless communications in the cellular network. In that case, the RSSI measurement block 170 and controller 172 can take RSSI measurements as described above on a more regular basis without interrupting the service, and can then be used to control the gain applied to received and/or transmitted signals more frequently, as required.

There is thus described an antenna that allows the network operator to control the size and shape of a cell served by the antenna easily, and allows the network operator to have access to good information about the status of the network in order to plan any such changes to the sizes and shapes of cells.

The invention claimed is:

1. An antenna, comprising:

a plurality of antenna elements;

a beam forming Butler matrix, having a plurality of antenna ports and a plurality of input/output ports, with each of said antenna elements being connected to a respective port of the beam forming Butler matrix;

transceiver circuitry, connected to each of the plurality of input/output ports of the beam forming matrix by means of a plurality of respective transmit and receive paths and a respective duplexer, wherein an individual transmit and receive path of the plurality of respective transmit and receive paths is separately available for each of the plurality of input/output ports;

individually controllable gain control elements located in each of the transmit and receive paths;

a detector configured to detect signal strengths of received signals; and a controller configured to control said gain control elements on the basis of the detected signal strengths.

2. An antenna as claimed in claim 1, wherein the individually controllable gain control elements comprise attenuators.

3. An antenna as claimed in claim 1, comprising respective amplifiers in each of said transmit and receive paths.

4. An antenna as claimed in claim 3, wherein the individually controllable gain control elements comprise means for switching off said respective amplifiers in the transmit and receive paths.

5. An antenna as claimed in claim 1, comprising a respective attenuator and a respective power amplifier in each of said transmit paths, and comprising means for controlling a bias applied to each power amplifier based on a degree of attenuation applied by the corresponding attenuator.

6. An antenna as claimed in claim 1, wherein the gain control elements located in each of the transmit and receive paths are controllable such that, when the gain in one of said paths is changed, the gains in the others of said paths are not changed.

7. An antenna as claimed in claim 1, wherein the respective gain control elements located in the transmit path connected to each antenna element, and located in the receive path connected to the same antenna element, are individually controllable.

8. An antenna as claimed in claim 1, wherein the detector configured to detect signal strengths of received signals comprises a means for detecting signal strengths of signals transmitted by other base stations.

9. An antenna as claimed in claim 8, wherein the means for detecting signal strengths of received signals comprises means for detecting signals in the transmit paths of said antenna elements, and means for detecting the signal strengths of said signals.

10. An antenna as claimed in claim 9, wherein the means for detecting the signal strengths is connectable in turn to the respective means for detecting signals in the transmit paths of said antenna elements.

11. An antenna as claimed in claim 1, wherein the detector configured to detect signal strengths of received signals comprises a second plurality of antenna elements co-located with said plurality of antenna elements, and means for detecting the signal strengths of signals detected by said second plurality of antenna elements.

12. An antenna as claimed in claim 1, further comprising:
a wireless connection between said detector configured to detect signal strengths of received signals and said means for controlling said gain control elements.

13. An antenna as claimed in claim 12, wherein said wireless connection operates according to a version of the IEEE 802.11 standard.

14. An antenna as claimed in claim 12, wherein said wireless connection operates according to a version of the IEEE 802.16 standard.

15. An antenna as claimed in claim 1, wherein said detector configured to detect signal strengths of received signals sends information to said means for controlling said gain control elements by means of a SMS message.

16. An antenna as claimed in claim 1, further comprising:
means for sending information from said detector configured to detect signal strengths of received signals to a network control centre.

17. An antenna, comprising:
a plurality of antenna elements;
transceiver circuitry, connected to each of the plurality of antenna elements by means of a plurality of respective transmit and receive paths, wherein an individual transmit and receive path of the plurality of respective transmit and receive paths is separately available for each of the plurality of antenna elements; and
individually controllable gain control elements located in each of the transmit and receive paths, and further comprising:
means for detecting signal strengths of received signals; and
means for controlling said gain control elements on the basis of the detected signal strengths.

18. An antenna as claimed in claim 17, wherein the means for detecting signal strengths of received signals comprises means for detecting signal strengths of signals transmitted by other base stations.

19. An antenna as claimed in claim 18, wherein the means for detecting signal strengths of received signals comprises means for detecting signals in the transmit paths of said antenna elements, and means for detecting the signal strengths of said signals.

20. An antenna as claimed in claim 19, wherein the means for detecting the signal strengths is connectable in turn to the respective means for detecting signals in the transmit paths of said antenna elements.

21. An antenna as claimed in claim 17, wherein the means for detecting signal strengths of received signals comprises a second plurality of antenna elements co-located with said plurality of antenna elements, and means for detecting the signal strengths of signals detected by said second plurality of antenna elements.

22. An antenna as claimed in claim 17, further comprising:
a wireless connection between said means for detecting signal strengths of received signals and said means for controlling said gain control elements.

23. An antenna as claimed in claim 22, wherein said wireless connection operates according to a version of the IEEE 802.11 standard.

24. An antenna as claimed in claim 22, wherein said wireless connection operates according to a version of the IEEE 802.16 standard.

25. An antenna as claimed in claim 17, wherein said means for detecting signal strengths of received signals sends information to said means for controlling said gain control elements by means of a SMS message.

26. An antenna as claimed in claim 17, further comprising:
means for sending information from said means for detecting signal strengths of received signals to a network control centre.

27. An antenna as claimed in claim 17, further comprising:
a beam forming Butler matrix, having a plurality of antenna ports and a plurality of input/output ports, with each of said antenna elements being connected to a respective port of the beam forming Butler matrix;
a plurality of respective duplexers, connected between the plurality of input/output ports of the beam forming matrix and the respective transmit and receive paths.

28. A method of controlling an antenna, wherein the antenna comprises:
a plurality of antenna elements; and
transceiver circuitry, connected to each of the plurality of antenna elements by means of a plurality of respective transmit and receive paths, wherein an individual transmit and receive path of the plurality of respective transmit and receive paths is separately available for each of the plurality of antenna elements;
wherein the method comprises:
detecting signal strengths of received signals; and
individually controlling gain control elements located in each of the transmit and receive paths on the basis of the detected signal strengths at the antenna elements associated with the transmit and receive paths.

29. A method as claimed in claim 28, wherein the individually controllable gain control elements comprise attenuators.

30. A method as claimed in claim 28, comprising switching on or off respective amplifiers in each of said transmit and receive paths.

31. A method as claimed in claim 28, comprising controlling the gain control elements located in each of the transmit and receive paths such that, when the gain in one of said paths is changed, the gains in the others of said paths are not changed.

32. A method as claimed in claim 28, comprising individually controlling the respective gain control elements located in the transmit path connected to each antenna element, and located in the receive path connected to the same antenna element.

33. A method as claimed in claim 28, wherein the detecting of signal strengths of received signals comprises detecting signal strengths of signals transmitted by other base stations.

34. A method as claimed in claim 33, further comprising detecting signals in the transmit paths of said antenna elements, and detecting the signal strengths of said signals.

35. A method as claimed in claim 34, further comprising detecting signals in the transmit paths of said antenna elements in turn.

36. A method as claimed in claim 28, further comprising:

sending information obtained from said detecting of the signal strengths of received signals to a network control centre.

37. A method as claimed in claim 28, comprising controlling said gain control elements in order to optimise one or more network parameters.

38. A method as claimed in claim 28, comprising controlling said gain control elements when installing the antenna.

39. A method as claimed in claim 38, comprising controlling said gain control at preprogrammed times.

40. A base station for a cellular wireless communications network, comprising an antenna as claimed in claim 1.

41. An antenna, comprising:

an antenna element;

transceiver circuitry;

a transmit path, for passing signals from the transceiver circuitry to the antenna element, and containing at least one gain control element;

a receive path, for passing signals from the antenna element to the transceiver circuitry, and containing at least one gain control element;

a duplexer, connected between the antenna element and the transmit and receive paths;

a first band pass filter, connected in the transmit path, for performing a blocking function; and a second band pass filter, connected in the receive path, for performing a blocking function;

a detector configured to detect signal strengths of received signals; and a controller configured to control said gain control elements on the basis of the detected signal strengths.

42. An antenna as claimed in claim 41, comprising a first amplifier in the transmit path and a second amplifier in the receive path.

43. An antenna as claimed in claim 42, wherein the first filter is connected before the first amplifier in the transmit path.

44. An antenna as claimed in claim 43, wherein the first filter removes substantially all noise generated by the transceiver circuitry at a receive frequency, and wherein a filter in the duplexer removes noise generated by the first amplifier.

45. An antenna as claimed in claim 42, wherein the second filter is connected after the second amplifier in the receive path.

46. An antenna as claimed in claim 45, wherein a filter in the duplexer rejects signals at frequencies relatively distantly separated from a receive frequency band without rejecting signals closely spaced from the receive frequency band, and the second filter rejects signals at frequencies closely spaced from the receive frequency band.

* * * * *